US005415302A

United States Patent [19]

Carlson et al.

[11] Patent Number: 5,415,302

[45] Date of Patent: May 16, 1995

[54] MODULAR SHELVING SYSTEM WITH A QUICK-CHANGE SHELF FEATURE

[75] Inventors: Bradley J. Carlson, Wilkes-Barre; David A. Reppert, Brodheadsville, both of Pa.

[73] Assignee: Metro Industries, Inc., Reno, Nev.

[21] Appl. No.: 93,331

[22] Filed: Jul. 22, 1993

Related U.S. Application Data

[63] Continuation of Ser. No. 783,208, Oct. 28, 1991, abandoned.

[51] Int. Cl.[6] ..... A47F 5/00

[52] U.S. Cl. ..... 211/187; 211/181; 108/144; 248/243

[58] Field of Search ..... 211/181, 187, 186; 108/144, 111; 248/243

[56] References Cited

U.S. PATENT DOCUMENTS

| | | | |
|---|---|---|---|
| 2,760,650 | 8/1956 | Franks | 211/148 |
| 2,897,978 | 8/1959 | Beckner | 211/148 |
| 3,138,123 | 6/1964 | Maslow | 108/159 |
| 3,208,408 | 9/1965 | Maslow | 108/148 |
| 3,306,466 | 2/1967 | Liston | 108/144 X |
| 3,316,864 | 5/1967 | Maslow | 108/148 |
| 3,424,111 | 1/1969 | Maslow | 108/144 |
| 3,479,975 | 11/1969 | Ferdinand et al. | 108/144 |
| 3,523,508 | 8/1970 | Maslow | 108/144 |
| 3,757,705 | 9/1973 | Maslow | 108/144 |
| 4,237,798 | 12/1980 | Welsch et al. | 108/144 X |
| 4,512,591 | 4/1985 | Plante | 108/111 X |
| 4,627,543 | 12/1986 | Nicely | 211/187 |
| 4,629,077 | 12/1986 | Niblock | 211/187 |
| 4,637,323 | 1/1987 | Nicely | 108/144 X |
| 4,750,626 | 6/1988 | Nicely | 211/187 |
| 4,799,818 | 1/1989 | Sudimak et al. | 403/107 |
| 4,811,670 | 3/1989 | Kolvites et al. | 108/107 |
| 4,892,044 | 1/1990 | Welsch | 108/154 |
| 4,960,308 | 10/1990 | Donaghy | 211/153 X |
| 4,964,350 | 10/1990 | Kolvites et al. | 108/110 |
| 4,989,519 | 2/1991 | Welsch et al. | 108/111 |

FOREIGN PATENT DOCUMENTS

| | | |
|---|---|---|
| 1515478 | 3/1968 | France . |
| 1138902 | 10/1962 | Germany . |
| 9109395 | 9/1991 | Germany . |

*Primary Examiner*—Robert W. Gibson, Jr.

*Attorney, Agent, or Firm*—Fitzpatrick, Cella, Harper & Scinto

[57] ABSTRACT

A shelving system includes a horizontal polygonal base shelf assembly and a substantially identical horizontal top shelf assembly, a plurality of vertical support posts, and one or more intermediate shelf assemblies positioned between the top shelf assembly and the bottom shelf assembly. Each intermediate shelf assembly is supported by hanger brackets which are removably secured to the support posts. Accordingly, each intermediate shelf assembly can be quickly installed and removed without the necessity of disassembling the other components of the shelving system. Optionally, an overlay may be placed on one or more of the shelf assemblies. The overlay is removably secured at its perimeter to the shelf assemblies by means of a snap-on trim panel. The overlay and trim panel may have different selected textures, patterns, and colors to provide an inexpensive, easily changeable informational and decorative display.

32 Claims, 6 Drawing Sheets

MODULAR SHELVING SYSTEM WITH A QUICK-CHANGE SHELF FEATURE

This application is a continuation of application Ser. No. 07/783,208 filed Oct. 28, 1991, now abandoned.

BACKGROUND OF THE INVENTION

1. Field of the Invention

The present invention relates generally to modular shelving systems. More particularly, the present invention relates to an improved "knockdown" modular, vertical, formed-wire shelving system, which is especially well suited for retail applications, and which may be readily assembled and disassembled without tools to facilitate shipping, storing, and cleaning.

Although the shelving system of the present invention is especially well-suited for use in holding and displaying merchandise in retail applications, it can be used with equal advantage in many other commercial, industrial and residential applications and environments.

2. Description of the Prior Art

Modular shelving systems are well known. For example, U.S. Pat. Nos. 3,138,123 (Maslow) and 3,208,408 (Maslow) disclose knockdown shelving units that have achieved great commercial success under the trademark ERECTA SHELF of Applicant's Assignee, InterMetro Industries Corporation.

U.S. Pat. Nos. 3,424,111 (Maslow) and 3,523,508 (Maslow) disclose a modular adjustable shelving system that has also achieved great commercial success under InterMetro Industries' trademark SUPER ERECTA SHELF. This system comprises a formed-wire shelf component having a frusto-conically-shaped collar at each corner for receiving a support post. Each collar tapers outwardly toward its lower extremity when viewed in normal use. Generally cylindrical support posts, each having a plurality of uniformly spaced annular grooves formed in its outer surface, are secured to the shelf by means of a mounting assembly. Each mounting assembly comprises at least two separate, complementary, conical-shaped mounting members which are joined about and at least partially surround the support posts to define a sleeve. The outer surface of each sleeve is frusto-conically shaped. Thus, the mounting member is thickest at its bottom. The sleeves are sized to fit snugly within the shelf collars. A rib formed on an inside surface of each sleeve is sized to engage the grooves formed in the support posts.

In use, sleeves are first placed about each support post such that the rib formed on the inside surface of each sleeve engages an appropriate groove in the support post at the desired height. The support posts with the sleeves mounted thereon are then each passed through one respective collar at a corner of each shelf. The collars, sleeves, and posts firmly engage each other due to their relative respective sizes. When all support posts are inserted, the shelving system is placed in position and is ready for use. As the load on the shelf increases, a radially-inwardly directed force between the collars and sleeves brings the sleeves into locking relation with the posts due to the wedging action between the collars and sleeves.

U.S. Pat. No. 3,757,705 (Maslow) discloses an adjustable shelving system similar to U.S. Pat. No. 3,523,508.

Other examples of known shelving systems are disclosed in U.S. Pat. No. 3,316,864 (Maslow); U.S. Pat. No. 4,629,077 (Niblock); U.S. Pat. No. 4,799,818 (Sudimak, et al.); U.S. Pat. No. 4,811,670 (Kolvites, et al.); U.S. Pat. No. 4,892,044 (Welsch); U.S. Pat. No. 4,964,350 (Kolvites, et al.); and U.S. Pat. No. 4,989,519 (Welsch, et al.).

Although the foregoing shelving systems are well suited for many varied applications, there is a need for a formed-wire modular shelving system that is particularly well adapted for applications in retail establishments. Such a shelving system would allow for the easy installation or removal of one or more shelves without requiring the disassembly of the entire shelving system.

There is the further need for providing a shelving system with trim features for readily and inexpensively changing its appearance for promotional and/or informational purposes.

SUMMARY OF THE INVENTION

It is an object of the present invention to improve upon the modular shelving systems known in the prior art.

It is another object of the present invention to provide an inexpensive, knockdown, modular shelving system that can be readily assembled and disassembled with minimal effort and without tools yet still has high strength, stability, and rigidity.

It is still another object of the present invention to provide a substantially open, formed-wire shelving system which is aesthetically pleasing, simply fabricated, stable in use, corrosion-resistant and readily cleaned.

It is another object of the present invention to provide an inexpensive, formed-wire shelving system that includes trim features for changing its appearance for promotional and informational display purposes.

It is a further object of the invention to provide a shelving system which permits the easy installation and/or removal of one or more shelves without requiring the disassembly of the entire shelving system.

It is still a further object of the invention to provide a shelving system comprising a base shelf assembly, a top shelf assembly, a plurality of support posts disposed between and removably secured to the base shelf assembly and the top shelf assembly, a plurality of hanger brackets removably secured to the posts, wherein the hanger brackets are disposed in at least one group having a common elevation, and at least one intermediate shelf being supported by a group of hanger brackets.

A more complete appreciation along with an understanding of other aspects, objects, features, and advantages of the present invention will become apparent from the following detailed description, when considered in conjunction with the accompanying drawings.

DETAILED DESCRIPTION OF THE PREFERRED EMBODIMENT

Initially, for purposes of explanation, the attitude and location of components of the shelving system of the present invention will be defined with reference to a fully assembled system when viewed in normal use. Accordingly, the term "horizontal" refers to a direction parallel to a surface on which the fully assembled shelving system is supported in normal use. Similarly, the term "vertical" refers to a direction substantially perpendicular to the horizontal direction. "Base" refers to the end of the shelving system closest to the surface on which the shelving system is supported, and "top" refers to the opposite end. The "front" and "rear", "left side" and "right side" of the shelving system are relative terms as will be defined below.

Figure 1:
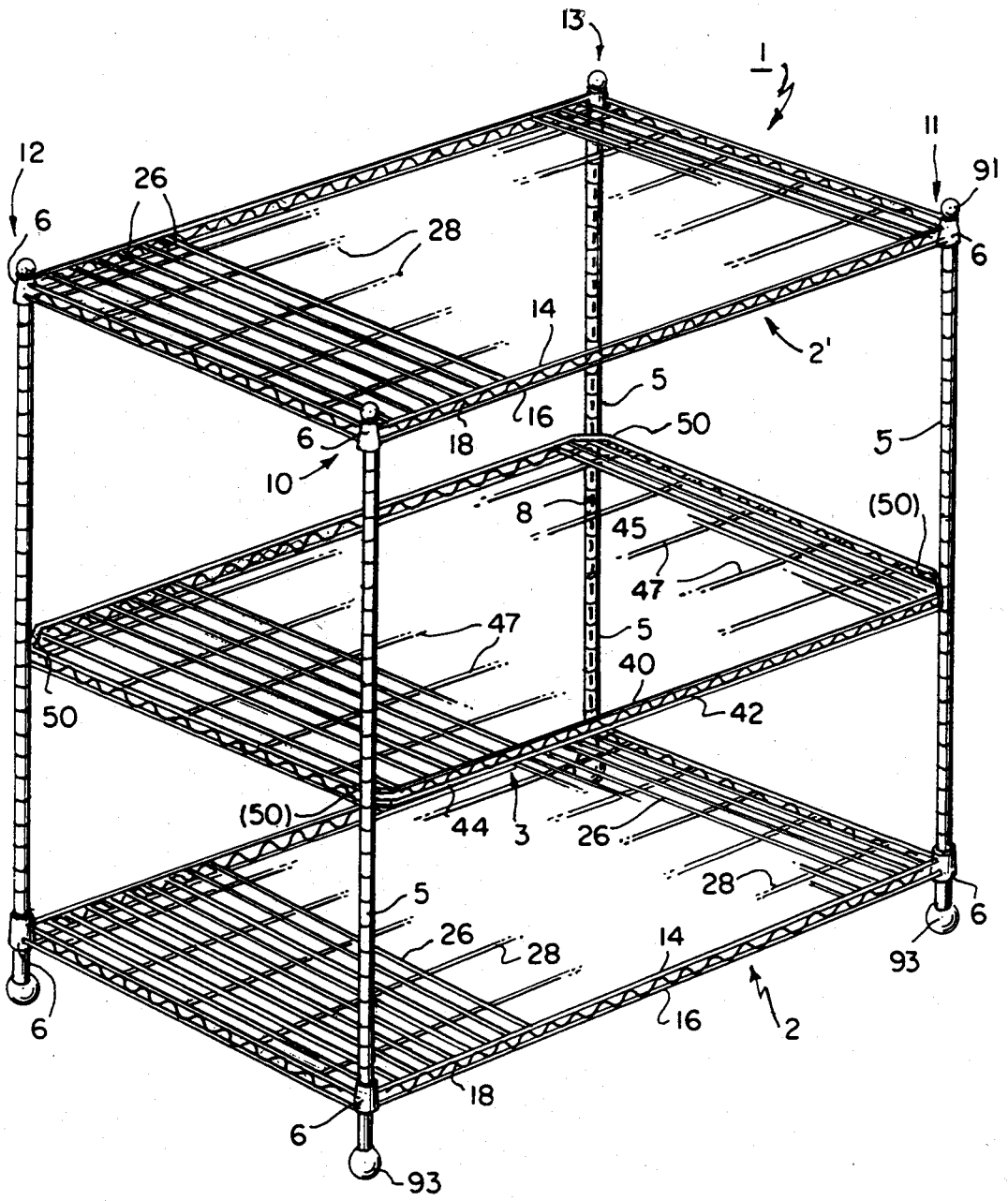
FIG. 1 is a fragmented, perspective view of an assembled modular shelving system, constructed in accordance with a preferred embodiment of the present invention.

FIGS. 1 illustrates a preferred embodiment of the shelving system 1. For purposes of explanation, reference numerals 10, 11, 12 and 13 respectively designate left-front, right-front, left-rear, and right-rear corners of the shelving system 1. While the system 1 will be described in detail below, it generally comprises a first polygonal frame assembly serving as a base shelf assembly 2, and a second identical frame assembly 2' serving as a top shelf assembly, one or more intermediate shelf assemblies 3, a plurality of hanger brackets 50, which are illustrated more clearly in other figures and are described in detail below, and a plurality of support posts 5.

While the shelf assemblies 3 are denoted as "intermediate", it is to be understood that for purposes of this specification and the concluding claims they be mounted between or on either side of the base and top shelf assemblies.

A collar 6 of the type described in U.S. Pat. Nos. 3,424,111; 3,523,508; 3,757,705 (all to Maslow), which are incorporated herein by reference, is provided at each corner of the base and top shelf assemblies 2,2'. Each collar 6 may be removably secured to a support post 5. If desired, decorative post caps 91, or post feet 93 may be attached to the support posts 5.

While corner post, shelf collar, and sleeve configurations such as are shown in U.S. Pat. No. 3,523,508 and U.S. Pat. No. 3,757,705 have been described in connection with one preferred embodiment, other corner post configurations adapted to support the top and bottom shelves may be provided.

Figure 2A:
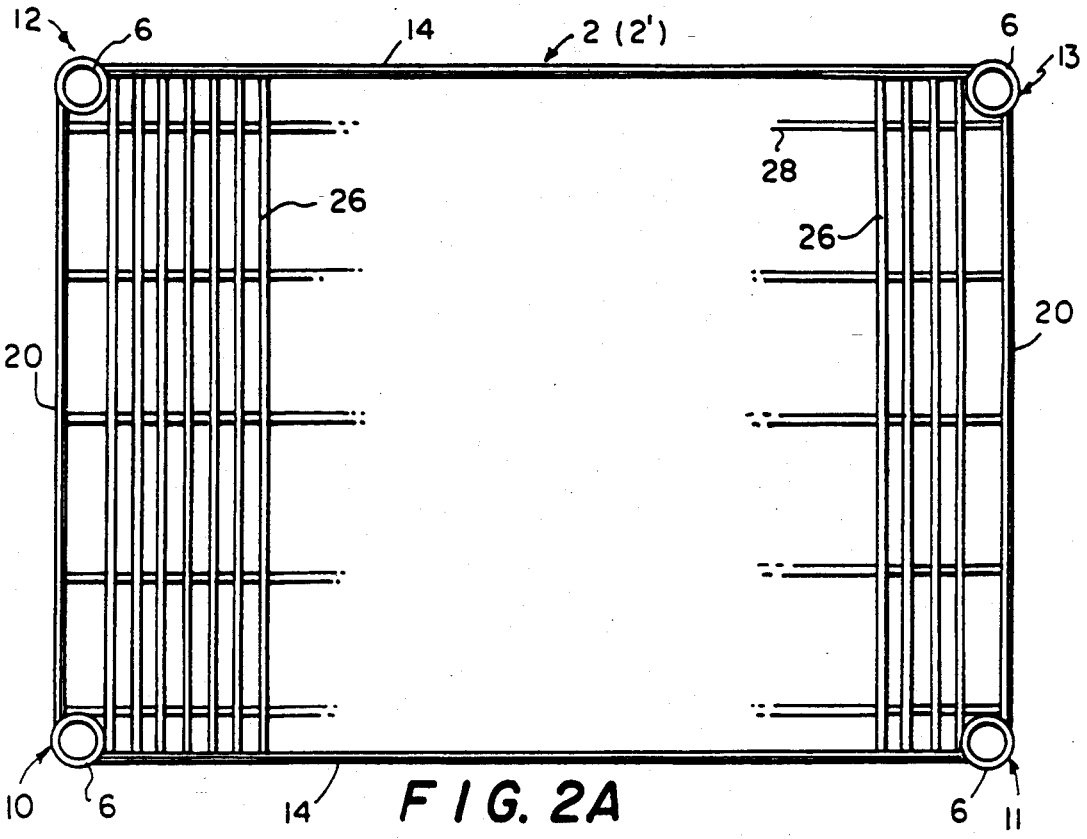
FIG. 2A is a top plan view of a shelf assembly, used in pairs as a base and a top, respectively, in the shelving system shown in FIG. 1.
Figure 2B:
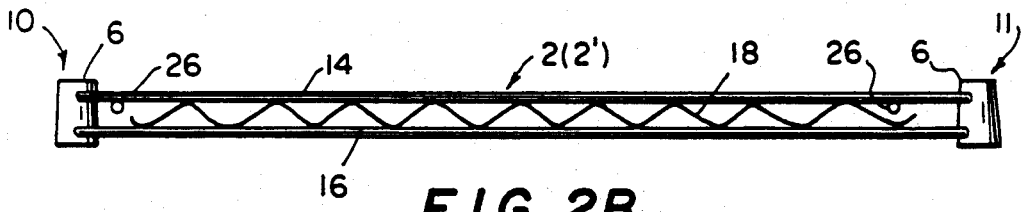
FIG. 2B is a front elevational view of the shelf assembly shown in FIG. 2A.
Figure 2C:
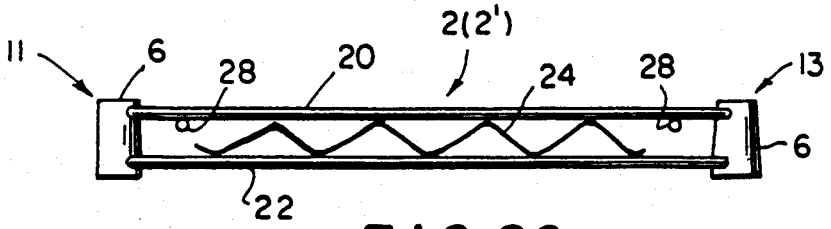
FIG. 2C is a right-side elevational view of the shelf assembly shown in FIG. 2A.

Referring now more specifically to FIGS. 2A through 2C, in a preferred embodiment of the invention, both base and top shelf assemblies 2,2' are generally rectangular and have a relatively long dimension running along the front and back, and a relatively short dimension running along the left and right sides of the shelving system 1. A typical shelf assembly may be approximately 36"×24"×5/16". Of course, many other sizes are possible. Other shapes of shelving systems, such as trapezoidal, triangular, and the like, also are possible.

As noted, both shelf assemblies 2,2' have a frustoconical collar 6 disposed at each corner. Each of the collars 6 is arranged so as to taper outwardly toward its lower extremity when the shelving system 1 is positioned in normal use. The collars 6 may be fabricated from cold-rolled steel or stainless steel although any metal may be used. Four snake-like trusses to be discussed below, along with the collars 6, define the perimeter of the frame assemblies 2,2'. A mat is made up of intersecting wire rods 26 and 28 that are welded to the under side of the upper ribs forming the snake trusses, and also where they intersect each other. The mat forms the support surface of the frame assemblies 2,2'.

With reference to FIG. 2B, a first pair of the snake trusses which form the front and back of the shelf assemblies 2,2' now will be discussed. The upper rib 14 and an equal length lower rib 16, formed, for example, from ¼ inch bright basic steel (B.B.S.) wire are welded at both ends to the collars 6 at the left-front corner 10 and the right-front corner 11 of the frame assemblies 2,2'. A continuous, snake-like rib 18 formed, for example, from number 6 American Wire Gage (AWG) B.B.S. wire is sized so as to fit between the upper and lower ribs 14 and 16 and is welded at the points where it comes in contact with the upper and lower ribs. Of course, many other wire sizes may be used to form the snake trusses depending on material cost, availability, the intended loading of the shelving system, etc. The wire rods 26 are welded at a top surface thereof to the underside of upper rib 14.

The snake trusses function as stiffener trusses at the front and back of the base and top shelf assemblies 2,2', respectively.

Next, as shown in FIG. 2C, a second pair of snake-like trusses form the left side and the right side of base and top shelf assemblies 2,2'. Each of the second pair of snake trusses comprises an upper rib 20 and an equal length, lower rib 22, both being somewhat shorter than upper and lower ribs 14 and 16, respectively. Ribs 20 and 22 also are preferably made of ¼ inch wire and are welded to the collars 6 at the left front corner 11 and the right rear corner 13 of the frame assemblies 2,2'. Thus, ribs 20 and 22 are substantially perpendicular to upper and lower ribs 14 and 16. Another continuous snake-like rib 24, also preferably made of number 6 AWG B.B.S. wire, is sized to fit between the upper rib 20 and lower rib 22 and is welded at the points where it comes in contact with the upper and lower ribs. The wire rods 28 are welded at a top surface thereof to upper rib 20. Again, of course, many other wire sizes may be used to form the above-mentioned components as circumstances require.

This pair of snake trusses also function as stiffener trusses at the left and right sides of the base and top shelf assemblies 2,2', respectively.

Thus, the front and back snake trusses are disposed substantially perpendicular to the left and right side snake trusses and in cooperation with the collars 6 at the vertices, define the perimeter of the base and top shelf assemblies 2,2'.

As noted above, the top shelf assembly 2' is identical to base shelf assembly 2. Consequently, its construction need not be separately discussed.

Figure 3:
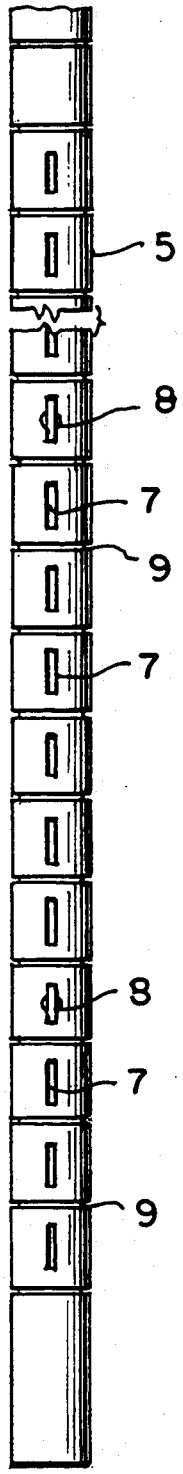
FIG. 3 is a fragmented, elevational view of a support post used in the shelving system shown in FIG. 1.

FIG. 3 shows a fragmented view of a support post 5. As noted generally above, a plurality of circumferential grooves 9, spaced apart at substantially regular intervals are formed on the support post 5. These grooves are provided to receive the ribs formed on an inside surface of a supporting frusto-conical sleeve (not shown in FIG. 3) such as that described in U.S. Pat. Nos. 3,523,508 and 3,757,705 (both to Maslow), which are also incorporated herein by reference.

In addition, a plurality of elongated hanger bracket-receiving slots 7 are formed in the support posts 5 at regular intervals. Periodically, the slots are provided, as shown at reference numeral 8, with an arcuate center portion that is a distinguishing detail to aid in the visual location of the hanger brackets in the supporting posts 5 as will be described below. The arcuate portions are generally cosmetic and for convenience are not necessary to the construction of the invention. The slots cooperate with the specially designed hanger brackets to support one or more intermediate shelves in the shelving system.

The support posts 5 are generally hollow and are typically made of metal, most preferably nickel-chrome plated or decoratively coated cold-rolled steel or stainless steel sheet. These compositions are relatively lightweight, provide high structural rigidity, and are inexpensive to manufacture by known metal forming methods. Further, these materials are resistant to corrosion and are easily cleaned. Still further, the bracket-receiving slots 7,8 and the grooves 9 may be efficiently formed therein, using known metal forming methods.

Alternatively, the support posts 5 may be made of any conventional material which can be formed to define the above features, particularly including materials such as metals or plastics. Such alternative materials may be well suited to particular shelving system applications.

Figure 4:
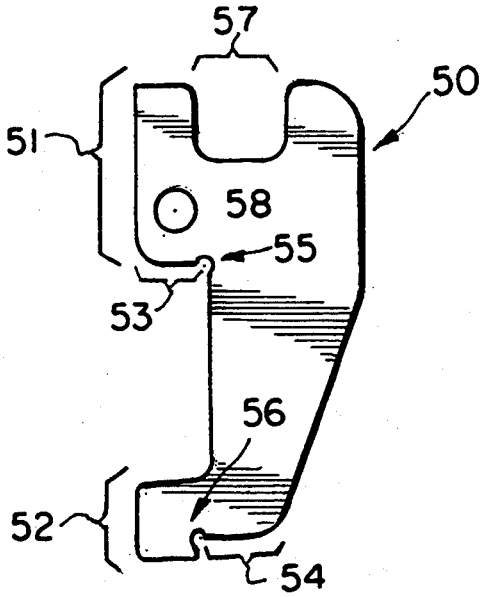
FIG. 4 is a side elevational view of a hanger bracket, a plurality of which are removably secured to the support posts to support the intermediate shelves in the shelving system shown in FIG. 1.

FIG. 4 shows a hanger bracket 50 which is inserted in slots 7 and/or 8 in a support post 5 and is used to support an intermediate shelf 3. Each hanger bracket 50 includes a first leg portion 51 which engages an upper slot and second leg portion 52 which engages a relatively lower slot of a support post 5. The corners 55 and 56 at the lower ends of each leg portion 51 and 52 are relieved somewhat to avoid the formation of stress fractures during load bearing conditions. To facilitate plating, a hole 58 is provided such that the unused hanger brackets may be supported on a pin. The hanger brackets may be made from a variety of readily available materials, including metals and plastics using conventional techniques. However, they are preferably stamped from cold-rolled steel.

Figure 5A:
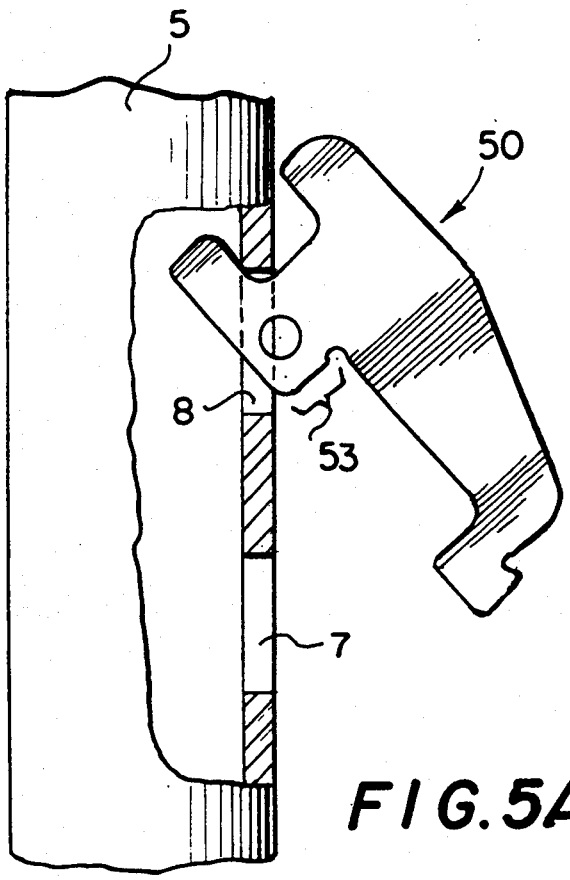
FIG. 5A is a fragmented, side elevational view of a hanger bracket shown in FIG. 4 partially inserted in a first opening of the support post shown in FIG. 3.

By way of example, as shown in FIG. 5A and FIG. 3, a hanger bracket 50 may be positioned at an angle relative to support post 5 and first leg portion 51 is inserted into a slot, such as slot 8, for example. A portion of the first leg portion 51 which forms a side of a shelf receiving notch 57 of the hanger bracket 50 contacts the internal wall of support post 5.

Figure 5B:
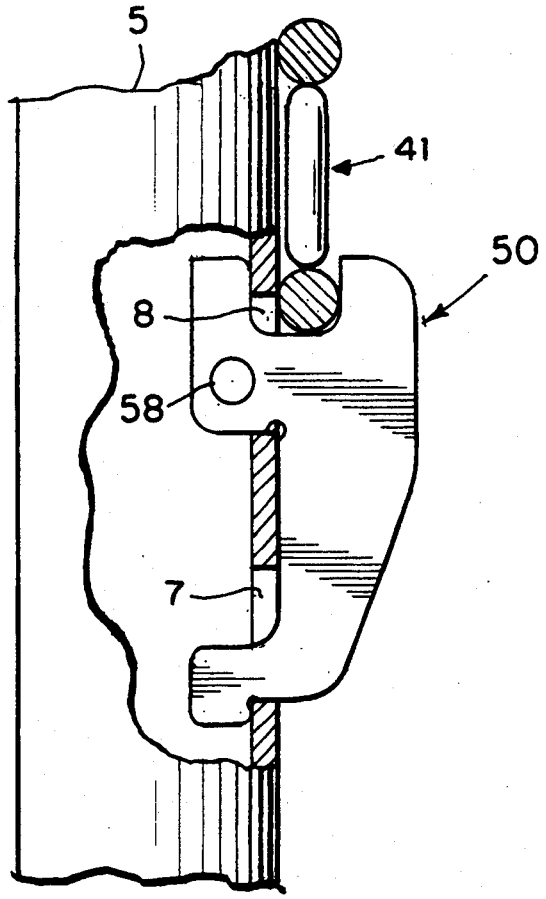
FIG. 5B, is a fragmented, side elevational view of a hanger bracket shown in FIG. 4 inserted in the first opening and a second opening of the support post shown in FIG. 3 resulting in a shelf-supporting position.

As shown in FIG. 5B, the hanger bracket 50 is then rotated about its contact portion with the internal wall of the support post 5 and the second leg portion is inserted into the relatively lower slot 7. It will be readily appreciated that the hanger bracket may engage any two adjacent slots. The hanger bracket 50 then is allowed to drop down in a bayonet-like manner such that load bearing portions 53 and 54 adjacent the lower ends of the legs 51 and 52 are supported by the bottoms of slots 8 and 7, respectively, and is ready to receive a mounting section of an intermediate shelf 3 in notch 57, as will be described in detail below. The width of the notch 57 is sized to take into account the wall thickness of a support post 5 and the diameter of a lower rib of a mounting section 41 of an intermediate shelf assembly 3 to ensure a snug fit which adds to the rigidity of the shelving system 1.

Figure 6A:
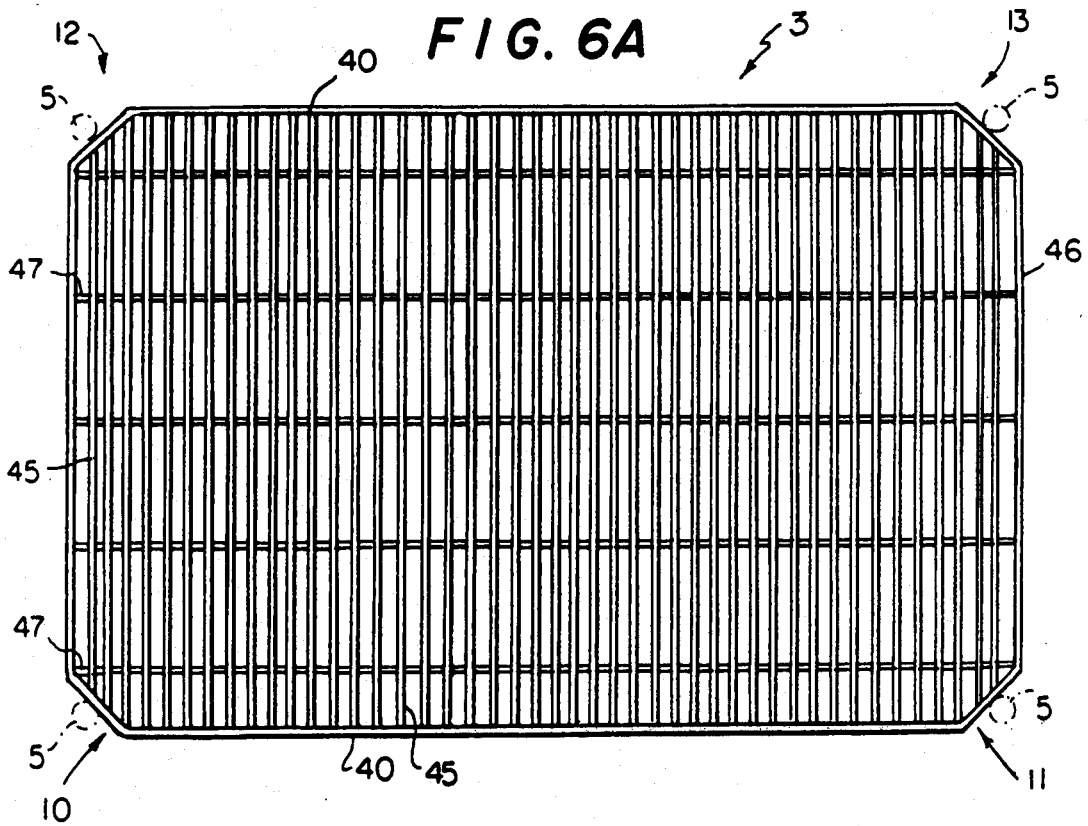
FIG. 6A is a top plan view of an intermediate shelf assembly used in the shelving system shown in FIG. 1.

FIG. 6A shows a top plan view of a preferred embodiment of an intermediate shelf assembly 3 of the shelving system 1. The intermediate shelf assembly 3 is a polygon and comprises at least three trusses substantially to define a perimeter of the intermediate shelf assembly 3. The region where adjacent trusses would otherwise intersect is truncated to define a mounting section 41 for engagement with one hanger bracket 50 of one group of hanger brackets supported at four common vertical locations on the support posts.

The intermediate shelf assembly 3 according to a preferred embodiment of the invention is generally rectangular and has a relatively long dimension running along the front and back, and a relatively short dimension running along the left and right sides of the shelving system 1. A typical intermediate shelf assembly may be approximately 36"×24"×5/16". Of course, other sizes are possible. Indeed other shapes of intermediate shelf assemblies, such as trapezoidal, triangular, and the like, also are possible.

As will be readily seen, the intersection of the front, back, right, and left sides of the intermediate shelf assembly are truncated to form mounting sections as discussed generally above. A mat of intersecting wire rods 45 and 47 form the primary support surface of the intermediate shelf assembly 3.

Figure 6B:
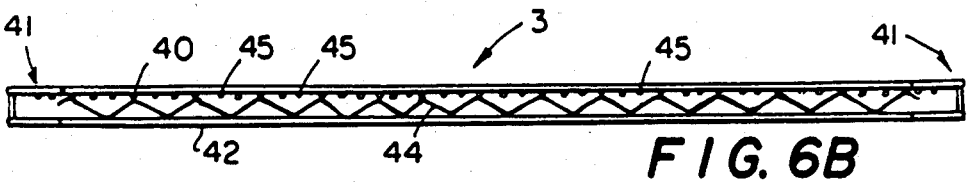
FIG. 6B is a front elevational view of the intermediate shelf assembly shown in FIG. 6A.

More particularly, as shown in FIG. 6B, a first pair of snake trusses form the front and back of the intermediate shelf assembly 3. For each snake truss an upper rib 40 and an equal length lower rib 42 are provided. A continuous, snake-like rib 44 is welded at the points where is comes in contact with the upper and lower ribs. A plurality of cross members 45 are welded at their top to the bottom of upper rib 40. The reference numeral 41 shows the portions of the truncated corners of the intermediate shelf assembly 3 which are viewed from the front. As noted, the truncated portions are referred to herein as the mounting sections of the intermediate shelf assembly 3.

Figure 6C:
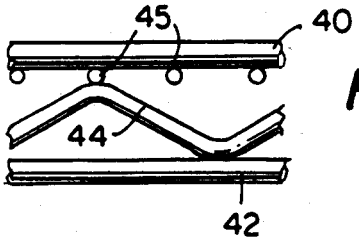
FIG. 6C is a partial detail of the front elevational view of the intermediate shelf assembly shown in FIG. 6B.

With reference to FIG. 6C, it is seen that the snake-like rib 44 is welded at each of its apexes to an underside of a wire rod 45.

Figure 6D:
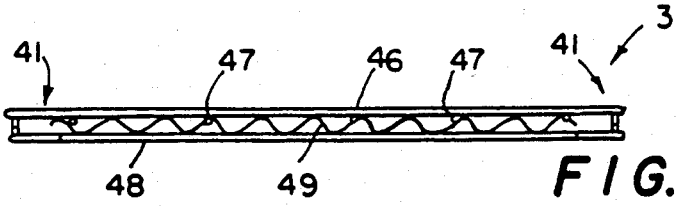
FIG. 6D is a right-side elevational view of the intermediate shelf assembly shown in FIG. 6A.

With reference to FIG. 6D, it is seen that the right side of the intermediate shelf assembly is formed substantially similar to that of the front of the intermediate shelf assembly. Specifically, an upper rib 46 and a lower rib 48 are connected by means of a continuous snake-like rib 49 which is welded where it comes in contact with the ribs. It will be understood that although the upper ribs 40 of the front and back of the intermediate shelf assembly 3 are numbered differently than the upper ribs 46 of the sides of the intermediate shelf assembly, one continuous rib may be used to form the entire perimeter. The same is true of the lower ribs.

Cross members 47 are welded at their top surface to an underside of upper rib 46 and to the underside of cross-members 45 at the point where they intersect. The reference number 41 shows the portions of the truncated corners of the intermediate shelf assembly 3 which are viewed from the right side.

Figure 7:
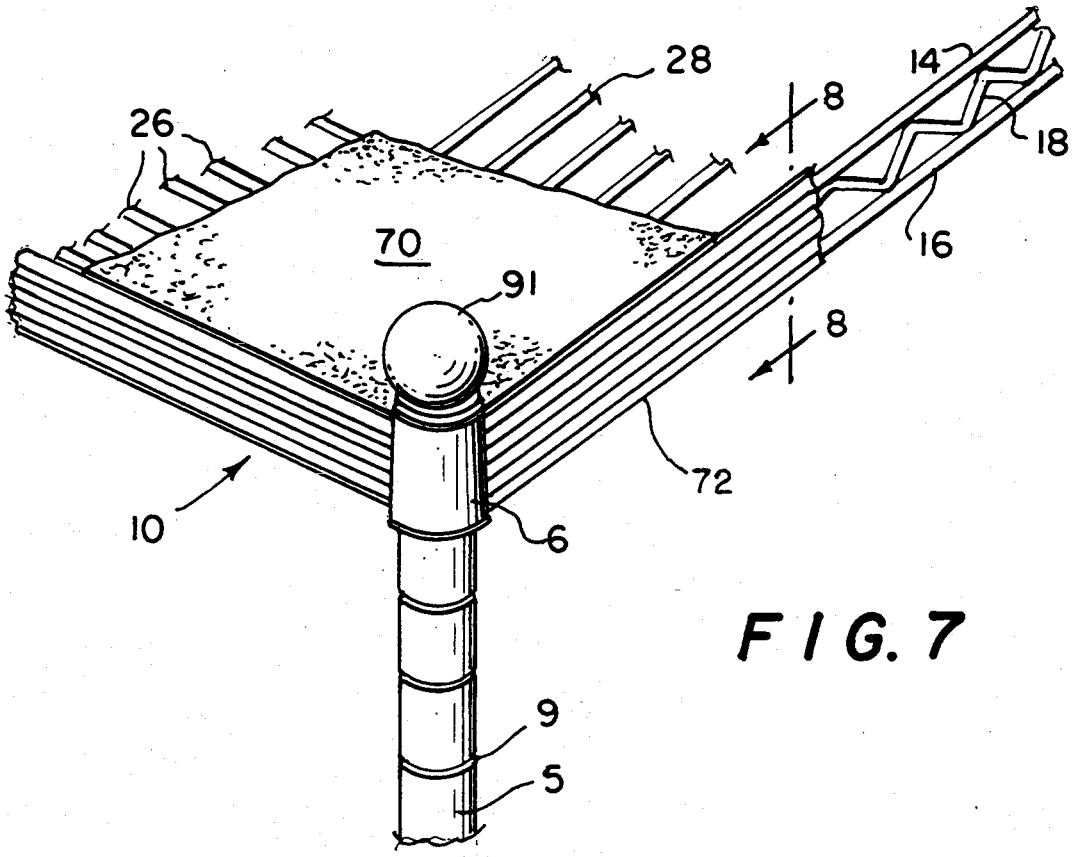
FIG. 7 is a fragmented, perspective view of a left-front corner of the top shelf assembly shown in FIGS. 2A through 2C and the support post shown in FIG. 3 with a post cap inserted therein and the interface of a trim panel with a shelf overlay.

FIG. 7 shows a fragmented perspective view of a left-front corner of a top shelf assembly 2' of the shelving system 1. (It will be readily understood that the following discussion is generally applicable to base shelf assembly 2 and to other corners of the shelving system 1.) A decorative overlay 70 is an additional feature which may be optionally used in the shelving system 1. The overlay 70 is sized to fit within the perimeter defined by the upper ribs 14 and collars 6 and is supported by the wire mat formed by the intersecting wire rods 26 and 28 of the top shelf assembly 2'. A trim panel 72 is snapped on to a snake truss on one or more sides of the shelving system 1 to removably secure the overlay 70 in place. Preferably, trim panels 72 are snapped onto all of the sides of the shelving system 1.

Overlays may also be used with the intermediate shelf assemblies 3. Of course the corners of the overlay must be truncated to conform to the shape of the intermediate shelf assembly 3.

Figure 8:
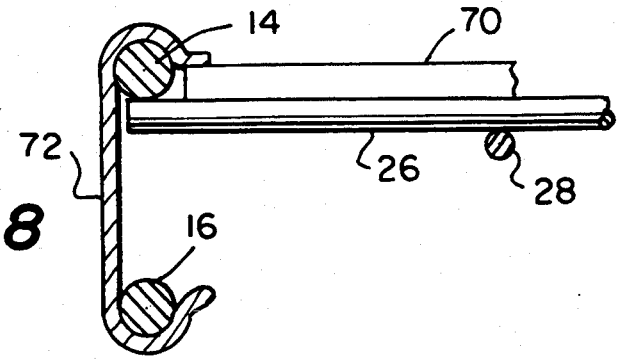
FIG. 8 is a fragmented, partial section view taken along line 8—8 of FIG. 7.

FIG. 8 is a fragmented partial cross-section taken along line 8—8 of FIG. 7. Trim plate 72 is a thermoplastic extrusion and is used to secure the decorative overlay to the shelf 2' by being formed with upper and lower partially circular channels that snap over upper and lower ribs respectively of a snake-truss. In practice, one trim plate is provided on each side of the shelf 2' which extends between a pair of collars 6.

In use, a decorative overlay 70 is selected and placed on one or more shelves each shelf and a number of trim plates will be selected and snapped onto each of the upper and lower ribs of the trusses forming the edges of the shelf. Thus, the trim panel 72 not only serves to hold the overlay 70 in place but also provides an additional decorative feature.

The decorative overlay 70 and trim panel 72 may be provided with a colored and/or patterned surface, and in fact, a different color and/or pattern may be provided for each of the shelves in the shelving system 1 to provide a decorative or informative display.

It is anticipated that a variety of overlays and trim plates will be provided to a retail establishment. Accordingly, as seasonal requirements change, a store designer can dramatically change the appearance of the store fixtures without a great deal of difficulty or expense.

Figure 9:
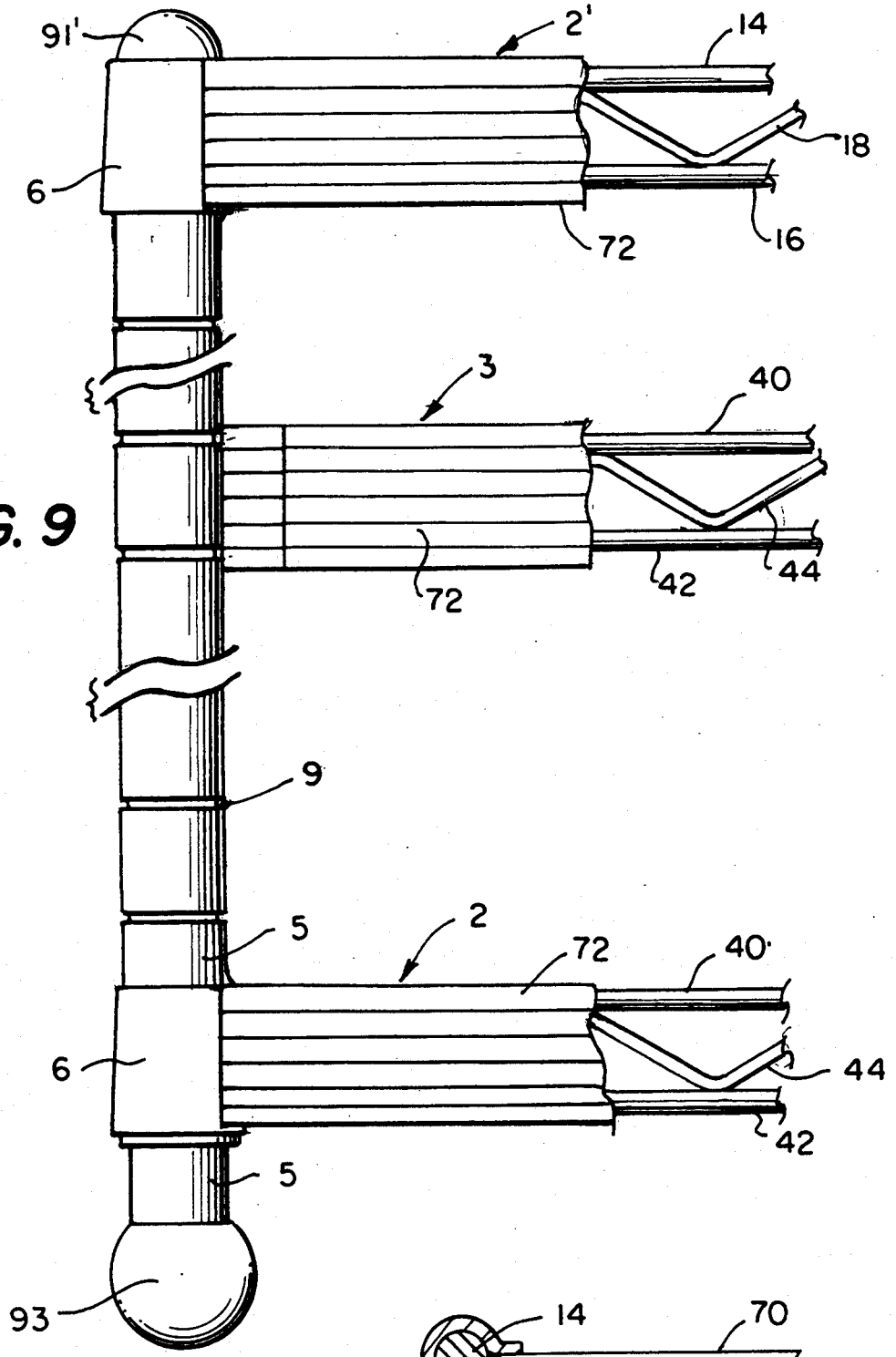
FIG. 9 is a fragmented, front elevational view of the left-front of the assembled shelving system shown in FIG. 1.

FIG. 9 shows a fragmented view of an elevation of the front-left corner of the shelving system 1. A base shelf assembly 2 and a top shelf assembly 2' are secured by means of collar 6 to a support post 5 in the manner hereinbefore discussed. An intermediate shelf assembly 3 is shown positioned between the base and top shelf assemblies 2,2'. Trim panels 72 are snapped onto the snake trusses forming the front edge of the shelf assemblies. A spherical foot cap 93 and a spherical top cap 91 are inserted respectively in the bottom and top of support post 5 to provide snag free finishes.

To assemble the shelving system, support posts 5 are passed through corresponding bottom and top collars 6 at each corner of the shelving system 1. The base and top shelf assemblies, 2,2' are then secured to a support post 5, by inserting selected mounting hardware such as discussed previously. Additional support posts 5 are passed through each of the remaining corner pairs of corresponding base and top collars 6 and are similarly secured. If desired, post caps 91 or 91' or post feet 93 are secured in the top bottom, respectively, of the support posts 5. The shelving system now is conveniently placed in the vertical position.

The shelving system is secured because the collars 6 grip the support posts 5 by means of the sleeves. The rigidity of the shelving system 1 is yet further increased by inserting downward pressure on the base and top shelf assemblies 2,2'. As noted previously, the load on the shelving system in normal use also adds to the rigidity and stability of the shelving system. The shelving system 1, thus configured, is now ready to receive one or more intermediate shelf assemblies.

After the base shelf assembly 2 and top shelf assembly 2' are secured at each corner to the support posts 5, a plurality of hanger brackets 50 are inserted in the support posts 5 as discussed hereinabove. One hanger bracket is located at a common elevation for each mounting section 41 of the intermediate shelf assembly 3. The hanger brackets 50 should face in a direction toward the interior of the shelving system 1. An intermediate shelf assembly 3 is inserted at an angle between the support posts 5 and the lower rib of the mounting sections 41 and is inserted on one side of the intermediate shelf assembly into the shelf receiving notch 57 of the hanger brackets 50 at that side as shown in FIG. 5B. The shelf is then rotated to a horizontal position such that the other side of the mounting section 41 engages the shelf receiving notches 57 in the hanger brackets at the other side.

Although the shelving system 1 has been shown with a base shelf assembly 2 and a top shelf assembly 2' and one intermediate shelf assembly 3, other configurations are contemplated. For example, additional intermediate shelf assemblies 3 may be conveniently added. Further, if a very tall shelving system is needed, it may be desirable to use an additional shelf assembly of the type used for the base and top in a central portion of the shelving system. A number of intermediate shelf assemblies 3 then may be inserted between such a "central" shelf assembly and the top shelf assembly and between the central shelf assembly and the base shelf assembly. The addition of one or more of such central shelf assemblies serves to make the shelving system even more stable and helps to prevent racking. Such a shelving system is still advantageous because the intermediate shelf assemblies 3 may still be readily installed and removed without disassembling the entire system.

Thus, what has been described is an inexpensive, stable, light-weight vertical shelving system capable of being very easily assembled and disassembled. In addition, the present invention provides interesting trim features which allow attractive commercial applications and otherwise provides for decorative and or informative displays.

Of course, all specific shapes, dimensions, wire sizes, number of shelves, and materials mentioned herein are provided by way of example only. Shelving systems fabricated in shapes, dimensions and using different wire sizes and materials and having a different number of shelves other than those discussed and illustrated herein also are contemplated.

Although specific embodiments of the present invention have been described above in detail, it will be understood that this description is merely for purposes of explanation. Various modifications of equivalent structures corresponding to the disclosed aspects of the preferred embodiments in addition to those described above may be made by those skilled in the art without departing from the spirit of the present invention which is defined in the following claims, the scope of which is to be accorded the broadest interpretation so as to encompass all such modifications and equivalent structures.

What is claimed is:

1. A shelving system, comprising:

a polygonal first shelf assembly;

a polygonal second shelf assembly;

a plurality of support posts disposed between and removably secured to said first shelf assembly and said second shelf assembly;

a plurality of bayonet-type hanger brackets removably secured to said support posts, said hanger brackets being disposed in at least one group having a common elevation; and at least one polygonal intermediate shelf assembly being removably supported by said one group of hanger brackets;

wherein each said intermediate shelf assembly includes a plurality of perimeter structures substantially to define a perimeter of said intermediate shelf assembly and wherein in a region of an intersection of adjacent perimeter structures said intermediate shelf assembly is truncated to define a mounting section for engagement with one hanger bracket of said one group of hanger brackets.

2. The shelving system according to claim 1, wherein each of said shelf assemblies is substantially rectangular.

3. The shelving system according to claim 1, wherein each of said perimeter structures is a truss comprising an upper rib and a lower rib.

4. A shelving system, comprising:

a first shelf assembly;

a second shelf assembly;

a plurality of support posts disposed between and removably secured to said first shelf assembly and said second shelf assembly;

a plurality of bayonet-type hanger brackets removably secured to said support posts, said hanger brackets being disposed in at least one group having a common elevation; and at least one intermediate shelf assembly being removably supported by said one group of hanger brackets;

wherein said support posts are substantially hollow, and have a plurality of substantially evenly-spaced openings therein for receiving said hanger brackets.

5. The shelving system according to claim 4, wherein said openings are substantially in the form of rectangular slots.

6. The shelving system according to claim 5, wherein selected rectangular slots have a distinguishing portion so as to be visually distinguishable from the remainder of said slots.

7. The shelving system according to claim 4, wherein each of said hanger brackets comprises a first leg portion adapted to be removably inserted in a first opening and a second leg portion adapted to be removably inserted in a second opening adjacent said first opening.

8. The shelving system according to claim 7, wherein each of said hanger brackets further comprises an intermediate shelf assembly receiving notch.

9. The shelving system according to claim 4, wherein said support posts are positioned relative to said first shelf assembly and said second shelf assembly such that said openings are oriented to face in a direction toward an interior of said shelving system.

10. The shelving system according to claim 1, wherein said first shelf assembly and said second shelf assembly are like-shaped polygons.

11. The shelving system according to claim 10, wherein said first shelf assembly and said second shelf assembly are both substantially rectangular.

12. A shelving system, comprising:

a first shelf assembly;

a second shelf assembly;

a plurality of support posts disposed between and removably secured to said first shelf assembly and said second shelf assembly;

a plurality of bayonet-type hanger brackets removably secured to said support posts, said hanger brackets being disposed in at least one group having a common elevation; and at least one intermediate shelf assembly being removably supported by said one group of hanger brackets;

wherein each of said first shelf assembly and said second shelf assembly comprises a plurality of perimeter structures and a plurality of support post receiving collars, at least one collar being located in at least one corner of said polygonal first shelf assembly and at least one collar being located in at least one corner of said polygonal second shelf assembly, said plurality of perimeter structures being secured to said collars.

13. The shelving system according to claim 12, wherein each of said plurality of perimeter structures is a truss comprising an upper rib and a lower rib.

14. A shelving system, comprising:

a first shelf assembly;

a second shelf assembly;

a plurality of support posts disposed between and removably secured to said first shelf assembly and said second shelf assembly;

a plurality of bayonet-type hanger brackets removably secured to said support posts, said hanger brackets being disposed in at least one group having a common elevation; and at least one intermediate shelf assembly being removably supported by said one group of hanger brackets; and at least one shelf overlay supported by each said intermediate shelf assembly.

15. The shelving system according to claim 14, wherein said shelf overlay has a textured surface.

16. The shelving system according to claim 14, wherein said shelf overlay has a patterned surface.

17. The shelving system according to claim 2, further comprising an elongated trim panel removably secured to a selected one of said plurality of perimeter structures.

18. The shelving system according to claim 17, wherein said trim panel comprises partially-circular portions formed at each long edge thereof and wherein a first partially-circular portion extends partially around and engages an upper edge of said selected perimeter structure, and a second partially-circular portion extends partially around and engages a lower edge of said selected perimeter structure.

19. The shelving system according to claim 17, wherein said trim panel is extruded from an elastically deformable material.

20. The shelving system according to claim 19, wherein said elastically deformable material is a thermoplastic material.

21. The shelving system according to claim 17, wherein said trim panel has a textured surface.

22. The shelving system according to claim 17, wherein said trim panel has a patterned surface.

23. A shelving system, comprising:

a first shelf assembly;

a second shelf assembly;

a plurality of support posts disposed between and removably secured to said first shelf assembly and said second shelf assembly;

a plurality of bayonet-type hanger brackets removably secured to said support posts, said hanger brackets being disposed in at least one group having a common elevation; and at least one polygonal intermediate shelf assembly being removably supported by said one group of hanger brackets; and at least one shelf overlay supported by at least one of said first shelf assembly and said second shelf assembly.

24. The shelving system according to claim 23, wherein said shelf overlay has a textured surface.

25. The shelving system according to claim 23, wherein said shelf overlay has a patterned surface.

26. The shelving system according to claim 23, wherein said first shelf assembly and said second shelf assembly are like polygons and comprise at least three trusses substantially to define a perimeter of each of said first shelf assembly and said second shelf assembly, wherein each of said trusses comprises an upper rib and a lower rib, and further comprising at least one trim panel adapted to be removably secured to a selected one of said plurality of trusses.

27. The shelving system according to claim 26, wherein said trim panel comprises partially-circular portions formed at each long edge thereof and wherein a first partially-circular portion extends partially around and engages an upper rib of said selected truss, and a second partially-circular portion extends partially around and engages a lower rib of said selected truss.

28. The shelving system according to claim 27, wherein said trim panel is extruded from an elastically deformable material.

29. The shelving system according to claim 27, wherein said elastically deformable material is a thermoplastic material.

30. The shelving system according to claim 26, wherein said trim panel has a textured surface.

31. The shelving system according to claim 26, wherein said trim panel has a patterned surface.

32. A shelving assembly, comprising:

a substantially rectangular first shelf assembly;

a substantially rectangular second shelf assembly;

a plurality of support posts disposed from and removably secured to said first shelf assembly and said second shelf assembly, wherein said support posts have a plurality of slots arranged at predetermined intervals, said slots being oriented toward an interior space of said shelving system;

a plurality of hanger brackets arranged in at least one group at a common elevation, wherein each said hanger bracket is formed to be removably inserted in a bayonet-like manner in a vertically-adjacent pair of said slots of said support posts; and at least one intermediate shelf being removably supported by said one group of hanger brackets, wherein each said intermediate shelf assembly is substantially rectangular and comprises a plurality of perimeter structures substantially to define a perimeter of said intermediate shelf assembly and wherein in a region of an intersection of adjacent perimeter structures said intermediate shelf assembly is truncated to define a mounting section for engagement with one hanger bracket of said one group of hanger brackets.

* * * * *

UNITED STATES PATENT AND TRADEMARK OFFICE

CERTIFICATE OF CORRECTION

PATENT NO. : 5,415,302

DATED : May 16, 1995

INVENTOR(S) : BRADLEY J. CARLSON, ET AL.

It is certified that error appears in the above-identified patent and that said Letters Patent is hereby corrected as shown below:

COLUMN 6

Line 56, "is" should read --it--.

COLUMN 10

Line 57, "elevation; and" should read --elevation;--.

COLUMN 11

Line 30, "elevation; and" should read -- elevation;--.

Line 31, "polygonal" should be deleted.

Signed and Sealed this

Twenty-third Day of January, 1996

*Attest:*

Bruce Lehman

BRUCE LEHMAN

*Attesting Officer*

*Commissioner of Patents and Trademarks*